US009066177B2

(12) United States Patent
Sandgren

(10) Patent No.: US 9,066,177 B2
(45) Date of Patent: Jun. 23, 2015

(54) METHOD AND ARRANGEMENT FOR PROCESSING OF AUDIO SIGNALS

(75) Inventor: Niclas Sandgren, Knivsta (SE)

(73) Assignee: TELEFONAKTIEBOLAGET L M ERICSSON (PUBL), Stockholm (SE)

( * ) Notice: Subject to any disclaimer, the term of this patent is extended or adjusted under 35 U.S.C. 154(b) by 530 days.

(21) Appl. No.: 13/071,779

(22) Filed: Mar. 25, 2011

(65) Prior Publication Data

US 2012/0243702 A1 Sep. 27, 2012

(30) Foreign Application Priority Data

Mar. 21, 2011 (WO) ..... PCT/SE2011/050307

(51) Int. Cl.

| | |
|---|---|
| ***H04R 3/02*** | (2006.01) |
| ***H04R 3/04*** | (2006.01) |
| ***G10L 21/0208*** | (2013.01) |
| *G10L 25/24* | (2013.01) |

(52) U.S. Cl.

CPC ..... *H04R 3/04* (2013.01); *H04S 2400/15* (2013.01); *G10L 21/0208* (2013.01); *G10L 25/24* (2013.01)

(58) Field of Classification Search

None

See application file for complete search history.

(56) References Cited

U.S. PATENT DOCUMENTS

| | | | | |
|---|---|---|---|---|
| 5,208,866 | A * | 5/1993 | Kato et al. | 381/107 |
| 5,627,938 | A * | 5/1997 | Johnston | 704/200.1 |
| 6,373,953 | B1 * | 4/2002 | Flaks | 381/94.7 |
| 6,459,914 | B1 * | 10/2002 | Gustafsson et al. | 455/570 |
| 2003/0216909 | A1 * | 11/2003 | Davis et al. | 704/210 |
| 2005/0091040 | A1 * | 4/2005 | Nam et al. | 704/201 |
| 2008/0069364 | A1 * | 3/2008 | Itou et al. | 381/17 |
| 2008/0281588 | A1 | 11/2008 | Akagi et al. | |
| 2009/0210224 | A1 | 8/2009 | Fukuda et al. | |
| 2010/0042407 | A1 * | 2/2010 | Crockett | 704/200.1 |
| 2010/0182510 | A1 | 7/2010 | Gerkmann et al. | |

(Continued)

FOREIGN PATENT DOCUMENTS

| | | | |
|---|---|---|---|
| JP | 2006-243178 | A | 9/2006 |
| JP | 2007-243856 | A | 9/2007 |

(Continued)

OTHER PUBLICATIONS

Welch, Peter D., "The use of fast Fourier transform for the estimation of power spectra: A method based on time averaging over short, modified periodograms," Published in: Audio and Electroacoustics, IEEE Transactions on, vol. 15, No. 2, Jun. 1967, pp. 70,73.*

Komninakis, C., "A fast and accurate Rayleigh fading simulator," Global Telecommunications Conference, 2003. GLOBECOM '03. IEEE, vol. 6, No., pp. 3306,3310 vol. 6, Dec. 1-5, 2003.*

Lemanski, J.B., "A New Vocal De-Esser", Preprints of papers presented at the AES Convention, May 12, 1981, pp. 1-11.

(Continued)

*Primary Examiner* — Duc Nguyen

*Assistant Examiner* — Taunya McCarty

(74) *Attorney, Agent, or Firm* — Rothwell, Figg, Ernst & Manbeck, P.C.

(57) ABSTRACT

Method and arrangement in an audio handling entity, for damping of dominant frequencies in a time segment of an audio signal. A time segment of an audio signal is obtained, and an estimate of the spectral density or "spectrum" of the time segment is derived. An approximation of the estimate is derived by smoothing the estimate, and a frequency mask is derived by inverting the approximation. An emphasized damping is assigned to the frequency mask in a predefined frequency range, as compared to the damping outside the predefined frequency range. Frequencies comprised in the audio time segment are then damped based on the frequency mask. The method and arrangement involves no multi-band filtering or selection of attack and release times.

28 Claims, 7 Drawing Sheets

(56) References Cited

U.S. PATENT DOCUMENTS

| | | | | |
|---|---|---|---|---|
| 2011/0045781 | A1 * | 2/2011 | Shellhammer et al. | 455/67.11 |
| 2012/0245717 | A9 * | 9/2012 | Forrester et al. | 700/94 |

FOREIGN PATENT DOCUMENTS

| | | | | |
|---|---|---|---|---|
| JP | 2008-76676 | A | | 4/2008 |
| WO | 9534964 | A1 | | 12/1995 |
| WO | 0124416 | A1 | | 4/2001 |
| WO | 2004109661 | A1 | | 12/2004 |
| WO | WO 2009074476 | A1 | * | 6/2009 |
| WO | WO 2010027509 | A1 | * | 3/2010 |

OTHER PUBLICATIONS

Stoica, P., et al., "Smoothed Nonparametric Spectral Estimation via Cepsturm Thresholding—Introduction of a Method for Smoothed Nonparametric Spectral Estimation", IEEE Signal Processing Magazine, Nov. 1, 2006, vol. 23, No. 6, pp. 34-45, ISSN 1053-5888.

Stoica, P., et al., "Total-Variance Reduction Via Thresholding: Application to Cepstral Analysis", IEEE Transactions on Signal Processing, Jan. 1, 2007, vol. 54, No. 1, pp. 66-72, ISSN 1053-587X.

International Search Report and Written Opinion issued in International application No. PCT/SE2011/050307 on Dec. 28, 2011, 11 pages.

* cited by examiner

[a s a sh a]

METHOD AND ARRANGEMENT FOR PROCESSING OF AUDIO SIGNALS

TECHNICAL FIELD

The invention relates to processing of audio signals, in particular to a method and an arrangement for damping of dominant frequencies in an audio signal.

BACKGROUND

In audio communication, where a speech source is captured at a certain venue through a microphone, the variation in obtained signal level (amplitude) can be significant. The variation may be related to several factors including the distance between the speech source and the microphone, the variation in loudness and pitch of the voice and the impact of the surrounding environment. When the captured audio signal is digitalized, significant variations or fluctuations in signal level can result in signal overload and clipping effects. Such deficiencies may result in that adequate post-processing of the captured audio signal becomes unattainable and, in addition, spurious data overloads can result in an unpleasant listening experience at the audio rendering venue.

Further, is well known that e.g. sibilant consonants, such as [s], [z], [ʃ], [ʒ] ('s', 'f', 'sh') in speech data are commonly captured in excess by microphones, which results in an unpleasant distorted listening experience when the captured or recorded signal is rendered to a listener. FIG. 1 illustrates a speech signal comprising sibilant consonants. In addition, some of these sibilant consonants are difficult to differentiate, which may result in confusion at the rendering venue.

A common way to reduce these deficiencies or drawbacks of unpleasant listening experiences due to e.g. sibilant consonants is to employ compression or filtering of the captured signal. In the case of sibilant consonants, such processing is referred to as "de-essing". Sibilant consonants are produced by the directing of a jet of air through a narrow channel in the vocal tract towards the sharp edge of the teeth. Sibilant consonants are typically located somewhere in between 2-12 kHz in the frequency spectrum. Hence, by compressing or filtering the signal in the relevant frequency band whenever the power of the signal in this frequency band increases above a pre-set threshold can be an effective approach to improve the listening experience. De-essing can be performed in several ways including: side-chain compression, split band compression, dynamic equalization, and static equalization However, a common property of all conventional de-essing techniques is that some kind of band-pass filtering is required to focus on the frequency band of interest. The problem of static equalization is evident as the frequency band of interest is subject to a constant change in gain, which may not be desired e.g. when there is no problem with excess sibilance. All other dynamic methods require selection of additional parameters such as e.g. a threshold to determine at which signal level the de-esser should be activated. For the compression based methods the selection of fade in (attack) and fade out (release) time parameters are extremely important to smooth out the artifacts introduced by the compression. The selection of user parameters, such as compression ratio, threshold, attack and release times is ambiguous, and thus no trivial task.

The inadequacy or complexity of known dynamic de-essing techniques invokes a desire for a simple and automatic de-essing routine with fewer or no user parameters to reduce the amount of user interaction, while requiring a low computational effort to speed up the signal post-processing.

SUMMARY

It would be desirable to achieve improved processing of audio signals comprising audio components implying an unpleasant listening experience, such as e.g. high energy sibilant consonants, while avoiding the problems of audio signal processing according to the prior art described above. It is an object of the invention to address at least some of the issues outlined above. Further it is an object of the invention to provide a method and an arrangement for damping of dominant frequencies in a predefined frequency range. These objects may be met by a method and an apparatus according to the attached independent claims. Embodiments are set forth in the dependent claims.

The concept of audio compression is well known and commonly used in practical applications. The main novelties of the suggested technique are that it invokes a non-parametric spectral analysis framework and it covers the entire frequency band in a frequency dependant manner without requiring any multi-band filtering (filter bank). Moreover, this may be done using a theoretically sound methodology, with low computational complexity, which produces a robust result.

The suggested technique requires no selection of attack and release time, since there are no abrupt changes in the slope of the amplitude, and hence the characteristic of the audio signal is preserved without any "fade in" or "fade out" of the compression. Yet, the level of compression is allowed to be time varying and fully data dependant as it is computed individually for each signal time frame.

Further, the considered approach performs de-essing, or similar, at the dominant frequencies in a limited frequency band. In other words, whenever the spectrum of the speech signal shows significant power at the frequency band comprising the frequencies e.g. of the sibilant consonants, this information is used for increasing the damping in the considered frequency band or range to suppress spurious frequencies that can result in an unpleasant listening experience. When a dominating frequency is detected in the considered limited frequency range, this information is trusted so much that the damping is emphasized in the considered frequency band, in relation to the gain (damping) for the out-of-band frequencies.

As opposed to conventional de-essing, no band-pass filtering of the signal to select the considered frequency band is required According to a first aspect, a method in an audio handling entity is provided for damping of dominant frequencies in a time segment of an audio signal. The method involves obtaining a time segment of an audio signal and deriving an estimate of the spectral density or "spectrum" of the time segment. An approximation of the estimated spectral density is derived by smoothing the estimate. A frequency mask is derived by inverting the derived approximation, and an emphasized damping is assigned to the frequency mask in a predefined frequency range (in the audio frequency spectrum), as compared to the damping outside the predefined frequency range. Frequencies comprised in the audio time segment are then damped based on the frequency mask.

According to a second aspect, an arrangement is provided in an audio handling entity for damping of dominant frequencies in a time segment of an audio signal. The arrangement comprises a functional unit adapted to obtain a time segment of an audio signal. The arrangement further comprises a functional unit adapted to derive an estimate of the spectral density of the time segment. The arrangement further comprises a functional unit adapted to derive an approximation of the spectral density estimate by smoothing the estimate, and a functional unit adapted to derive a frequency mask by inverting the approximation, and to assign an emphasized damping to the frequency mask in a predefined frequency range (in the audio frequency spectrum), as compared to the damping outside the predefined frequency range. The arrangement further comprises a functional unit adapted to damp frequencies comprised in the audio time segment, based on the frequency mask.

The above method and arrangement may be implemented in different embodiments. In some embodiments, the emphasized damping is achieved by raising the damping of the frequency mask to the power of a constant $\chi$ inside the predefined frequency range, where $\chi$ may be >1. The method is suitable e.g. for de-essign in the frequency range 2-12 kHz.

In some embodiments, the derived spectral density estimate is a periodogram. In some embodiments, the smoothing involves cepstral analysis, where cepstral coefficients of the spectral density estimate are derived, and where cepstral coefficients having an absolute amplitude value below a certain threshold; or, consecutive cepstral coefficients with index higher than a preset threshold, are removed.

In some embodiments, the frequency mask is configured to have a maximum gain of 1, which entails that no frequencies are amplified when the frequency mask is used. The maximum damping of the frequency mask may be predefined to a certain level, or, the smoothed estimated spectral density may be normalized by the unsmoothed estimated spectral density in the frequency mask. The damping may involve multiplying the frequency mask with the estimated spectral density in the frequency domain, or, configuring a FIR filter based on the frequency mask, for use on the audio signal time segment in the time domain.

The embodiments above have mainly been described in terms of a method. However, the description above is also intended to embrace embodiments of the arrangement, adapted to enable the performance of the above described features. The different features of the exemplary embodiments above may be combined in different ways according to need, requirements or preference

BRIEF DESCRIPTION OF THE DRAWINGS

The invention will now be described in more detail by means of exemplary embodiments and with reference to the accompanying drawings, in which.

DETAILED DESCRIPTION

Figure 1:
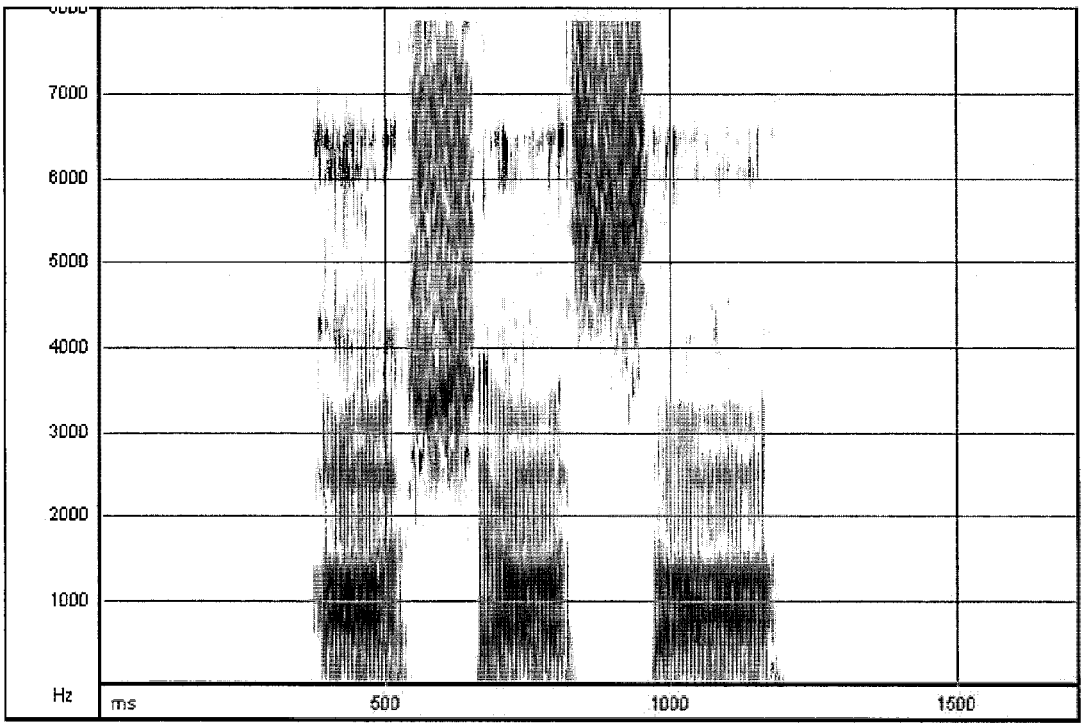
FIG. 1 shows a spectrogram of a speech signal comprising sibilant consonants.

Briefly described, amplitude compression is performed at the most dominant frequencies in a predefined frequency range, or set, of an audio signal, where the frequency range comprises a type of sound, which may need special attention, such as e.g. excess sibilant consonants. The most dominant frequencies can be detected by using spectral analysis in the frequency domain. By lowering the gain of, i.e. damping, the dominant frequencies, instead of performing compression when the amplitude of the entire signal increases above a certain threshold, the sine wave characteristics of the sound can be preserved. The added gain (i.e. damping, when the added gain is a value between 0 and 1 for all frequencies) is determined in an automatic data dependant manner. No bandpass filtering is involved in the suggested compression.

First, the process of deriving a frequency mask will be described, and then the suggested solution related to a certain frequency range or set of frequencies of the frequency mask.

It is assumed that an audio signal is digitally sampled in time at a certain sampling rate ($f_s$). For post-processing and transmission reasons the sampled signal is divided into time segments or "frames" of length N. The data in one such frame will henceforth be denoted $y_k$ (k=0,2, . . . , N−1).

Using e.g. Fourier analysis and specifically the Fast Fourier Transform (FFT) it is possible to obtain a spectral density estimate $\Phi_p$, such as the periodogram of the data $y_k$ $$\Phi_p = \frac{1}{N}\left|\sum_{k=0}^{N-1} y_k e^{-i\omega_p k}\right|^2 \quad p = 0, \ldots, N-1 \tag{1}$$

where $$\omega_p = \frac{2\pi}{N} p$$

are the Fourier grid points.

Typically, the periodogram of an audio signal has an erratic behavior. This can be seen in FIG. 2, where a periodogram is illustrated in a thin solid line. Using spectral information, such as the periodogram, as prior knowledge of where to perform signal compression is very unintuitive and unwise, since it would attenuate approximately all useful information in the signal.

However, it has now been realized that by using a technique that invokes a significant amount of smoothing, and hence estimating the "baseline" of the spectrum while excluding the details and sharp peaks, as prior information about the location of the dominating frequencies, compression can be performed at these relevant frequencies without introducing disturbing artifacts. For the computation of a smooth estimate of the periodogram, a technique involving cepstrum thresholding has been used, although alternatively other techniques suitable for achieving a smoothed spectral density estimate may be used.

The sequence $$c_k = \frac{1}{N}\sum_{p=0}^{N-1} \ln(\Phi_p)e^{i\omega_k p} + \gamma\delta_{k,0} \quad k = 0, \ldots, N-1 \tag{2}$$

where $$\delta_{k,0} = \begin{cases} 1 & \text{if } k = 0 \\ 0 & \text{else} \end{cases} \quad \gamma = 0.577216 \ldots$$

is well known as the cepstrum or cepstral coefficients related to the signal $y_k$. In addition, it is known that many of the N cepstrum coefficients typically take on small values. Hence, by thresholding or truncating these coefficient to zero in a theoretically sound manner (see [1][2]) it is possible to obtain a smooth estimate of (1) as $$\tilde{\Phi}_p = \alpha\hat{\Phi}_p \quad p = 0, \ldots, N-1 \tag{3}$$

where $$\hat{\Phi}_p = \exp\left[\sum_{k=0}^{N-1} \hat{c}_k e^{-i\omega_p k}\right] \quad p = 0, \ldots, N-1 \tag{4}$$

and where $$\alpha = \frac{\sum_{p=0}^{N-1} \Phi_p\hat{\Phi}_p}{\sum_{p=0}^{N-1} \hat{\Phi}_p^2}$$

is a normalization constant. In (4) the sequence $\hat{c}_k$ corresponds to the thresholded or truncated sequence $c_k$ in (2).

Figure 2:
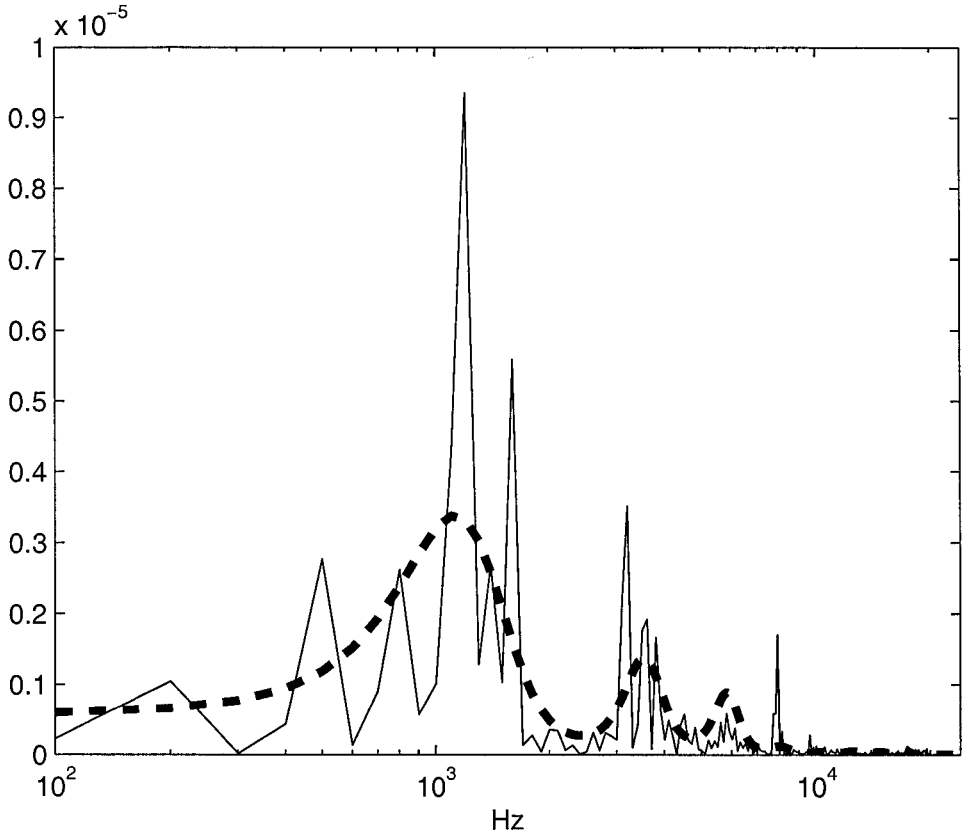
FIG. 2 shows a spectral density estimate (solid line) of an audio signal segment and a smoothed spectral density estimate (dashed line) according to an exemplifying embodiment.

In FIG. 2, which represents (the frequency contents of) a typical 10 ms time frame of a speech signal sampled at 48 kHz, the smoothed spectral density estimate obtained using the cepstrum thresholding algorithm of [1] is shown as a bold dashed line. Evidently, the dashed line is not an accurate estimate of the details of the solid line, which is why it serves the purposes so well. The frequencies with the highest spectral power are roughly estimated, resulting in a "rolling baseline".

The inverse of the smoothed spectral density estimate (dashed line) in FIG. 2 can be used as a frequency mask containing the information of at which frequencies compression is required. If the smoothed spectral density estimate (dashed line) had been an accurate estimate of the spectral density estimate (solid line), i.e. if the smoothing had been non-existent or very limited, using it as a frequency mask for the signal frame would give a very poor and practically useless result.

By letting the frequency mask have a maximum gain value of 1 it may be ensured that no amplification of the signal is performed at any frequency. The minimum gain value of the frequency mask, which corresponds to the maximal damping, can be set either to a pre-set level (5) to ensure that the dominating frequency is "always" damped by a known value. Alternatively, the level of maximal compression or damping can be set in an automatic manner (6) by normalization of the smoothed spectral density estimate using e.g. the maximum value of the unsmoothed spectral density estimate, e.g. the periodogram.

$$F_p = 1 - \lambda\frac{\tilde{\Phi}}{\max(\tilde{\Phi}_p)} \quad \text{where } 0 < \lambda < 1 \tag{5}$$

$$F_p = 1 - \frac{\tilde{\Phi}_p}{\max(\Phi_p)} \tag{6}$$

where p=0,2, . . . , N−1.

Figure 3:
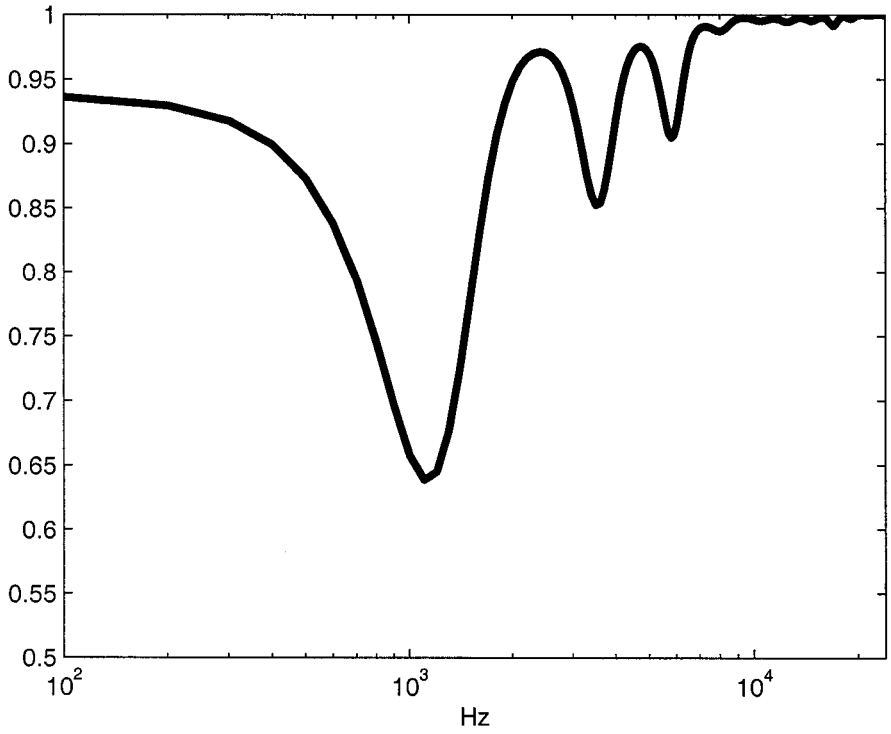
FIG. 3 shows a frequency mask based on a smoothed spectral density estimate, according to an exemplifying embodiment.

FIG. 3 shows the resulting frequency mask for the signal frame considered in FIG. 2 obtained using (6) which is fully automatic, since no parameters need to be selected. The computation of (3) may also be regarded as automatic, even though it may involve a trivial choice of a parameter related to the value of a cepstrum amplitude threshold [1][2], such that a lower parameter value is selected when the spectral density estimate has an erratic behavior, and a higher parameter value is selected when the spectral density estimate has a less erratic behavior. For the case of audio signals, the parameter may, however, be predefined to a constant value.

If the level of compression obtained using (6) is insufficient in a certain scenario it is possible to use (5) and let λ take on a desired value between 0 and 1.

The filter mask is then used either by direct multiplication with the estimated spectral density in the frequency domain to compute a compressed data set $\hat{y}_k$ (k=0,2, . . . , N−1), or, e.g. as input for the design of a Finite Impulse Response (FIR) filter, which can be applied to $y_k$ in the time domain.

As previously mentioned, an audio signal may comprise sounds which may cause an unpleasant listening experience for a listener, when the sounds are captured by one or more microphones and then rendered to the listener. When these sounds are concentrated to a limited frequency range or set, a special gain in form of emphasized damping could be assigned to the frequency mask described above, within the limited frequency range or set, which will be described below. The examples below relate to de-essing, i.e. where the sound which may cause an unpleasant listening experience is the sound of excess sibilants in the frequency range 2-12 kHz. However, the concept is equally applicable for suppression of other interfering sounds or types of sounds, which have a limited frequency range, such as e.g. tones or interference from electric fans.

Figure 4:
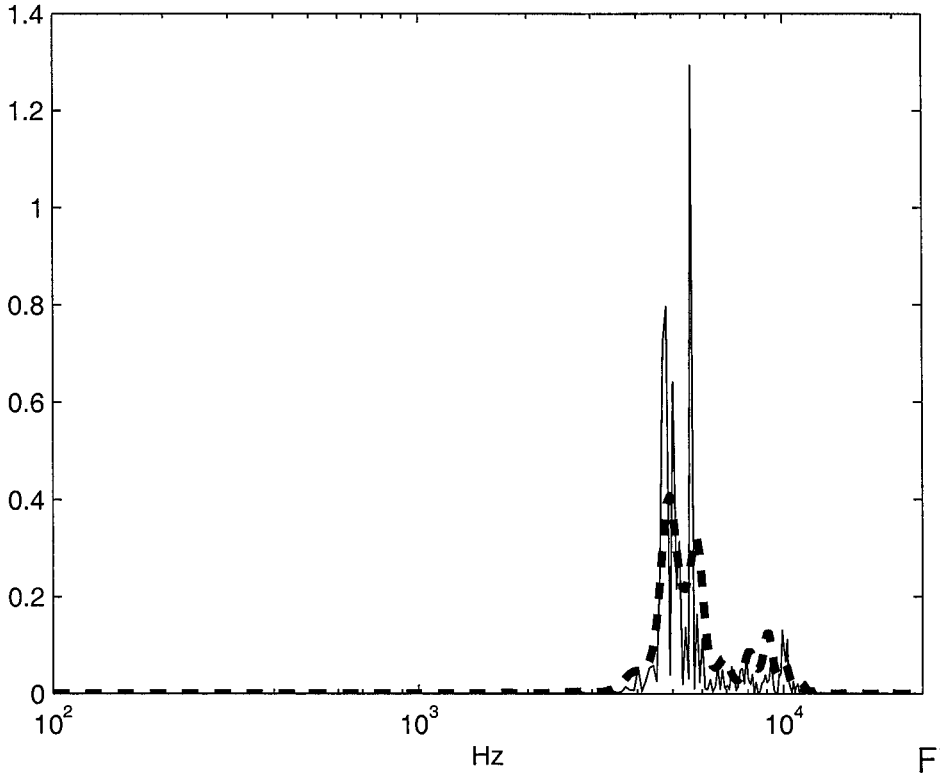
FIG. 4 shows a spectral density estimate (solid line) of an audio signal segment in a predefined frequency range, and a smoothed spectral density estimate (dashed line).

Assume that an audio signal comprising speech is captured in time frames of a length of e.g. 10 ms. Further, assume that the signal sampling rate, i.e. the sampling frequency, is sufficiently high for capturing sibilant consonants. The number of samples in one time frame is denoted N. The estimated spectral density of a typical signal time frame including a sibilant consonant is given in FIG. 4 (thin solid line). The audio signal, of which the periodogram is illustrated in FIG. 4, is sampled with a sampling frequency of 48 kHz.

An approximation of the estimated spectral density of the signal time frame is derived by smoothing the estimate. The approximation is illustrated as a dashed bold line in FIG. 4. The approximation could be derived using e.g. equation (3) described above.

In addition, let $F_p$ denote the frequency mask for the signal time frame in question, which may be obtained using e.g. either equation (5) or (6) described above. A modified frequency mask $\tilde{F}_p$ including a de-essing property can then be formulated as $$\tilde{F}_p = \begin{cases} F_p & p = 0, \ldots, p_{min} - 1, p_{max} + 1, \ldots, N/2 \\ F_p^{\chi} & p = p_{min}, \ldots, p_{max} \end{cases} \quad (7)$$

where $\chi>1$ is a constant, which will be further described below, and where the frequency interval or range $p_{min}, \ldots, p_{max}$ comprises the frequency interval which represent the sibilant consonants. In our example below $p_{min}, \ldots, p_{max}$ correspond to the frequency range 2-12 kHz.

Note that $$F_{N-p} = F_p \qquad p = 1, \ldots, \frac{N}{2} \quad (8)$$

and hence only the first N/2 points are considered in (7). The remaining points p=N/2+1, . . . , N can be obtained from (8). That is, the mask is mirrored around the center index in order to treat both positive and negative frequencies.

When the gain of the frequency mask $F_p \leq 1$ over the whole frequency range of the frequency mask, the effect of letting the constant $\chi(X)$ take on a value >1 results in an increase, which may be considerable, of the damping effect in the considered frequency band whenever sibilant consonants are present. The larger $\chi$ is selected, the more damping in the most dominant frequencies in the considered frequency band. However, for all other signal time frames where the dominant frequencies of the speech are located outside the frequency range given by $p_{min}, \ldots, p_{max}$, the modification to $F_p$ in (7) is more or less unnoticeable since $F_p^{\chi} \approx 1$ for all values of $\chi$ when $F_p$ is close to 1. To conclude, the choice of $\chi$ is not critical.

Figure 5:
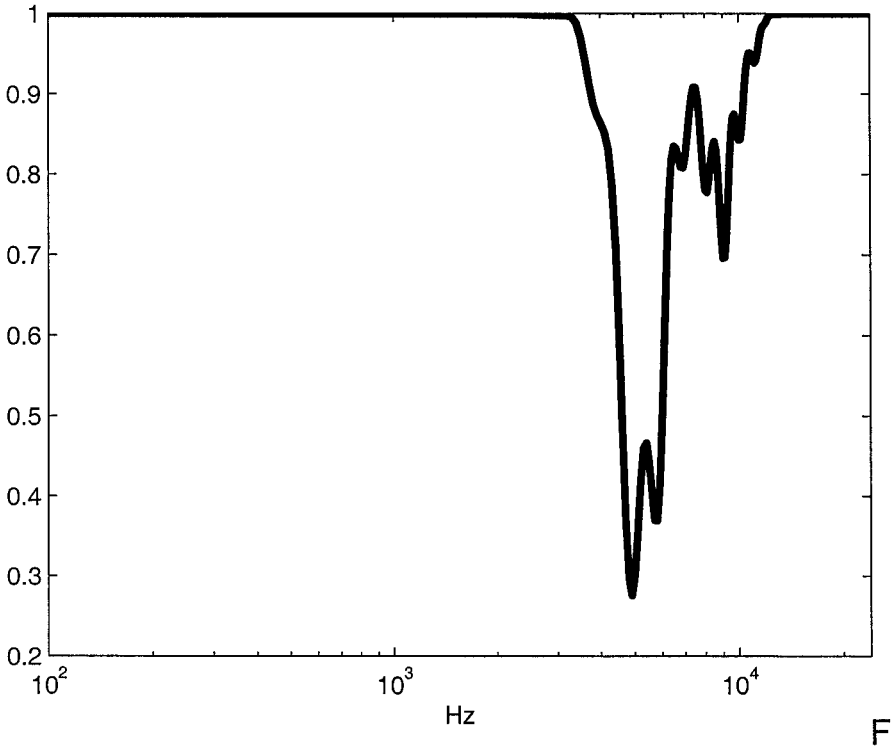
FIG. 5 shows a frequency mask in a predefined frequency range based on a smoothed spectral density estimate, according to an exemplifying embodiment.

In FIG. 5, the modified frequency mask obtained from (7) for the signal time frame presented in FIG. 2 is given. In the example illustrated in FIG. 5, the parameter $\chi$ is set to 5.

Figure 6:
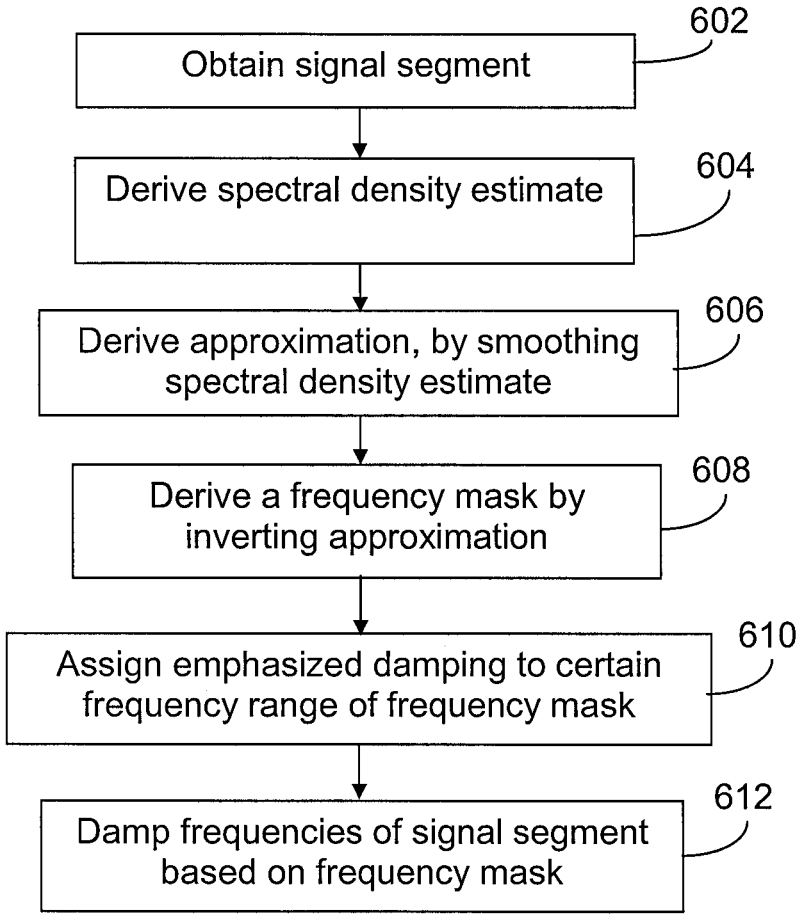
FIG. 6 is a flow chart illustrating a procedure in an audio handling entity, according to an exemplifying embodiment.

Example Procedure FIG. 6

An exemplifying embodiment of the procedure of damping dominant frequencies in a time segment of an audio signal will now be described with reference to FIG. 6. The procedure could be performed in an audio handling entity, such as e.g. a node or terminal in a teleconference system and/or a node or terminal in a wireless or wired communication system, a node involved in audio broadcasting, or an entity or device used in music production.

A time segment of an audio signal is obtained in an action 602. The audio signal is assumed to be captured by a microphone or similar and to be sampled with a sampling frequency. The audio signal could comprise e.g. speech produced by one or more speakers taking part in a teleconference or some other type of communication session. The audio signal is assumed to possibly comprise sounds, which may cause an unpleasant listening experience when captured by one or more microphones and rendered to a listener. The time segment could be e.g. approximately 10 ms or any other length suitable for signal processing.

An estimate (in the frequency domain) of the spectral density of the derived time segment is obtained in an action 604. This estimate could be e.g. a periodogram, and could be derived e.g. by use of a Fourier transform method, such as the FFT. An approximation of the estimated spectral density is derived in an action 606, by smoothing of the spectral density estimate. The approximation should be rather "rough", i.e. not be very close to the spectral density estimate, which is typically erratic for audio signals, such as e.g. speech or music (cf. FIG. 2). The approximation could be derived e.g. by use of a cepstrum thresholding algorithm, removing (in the cepstrum domain) cepstral coefficients having an absolute amplitude value below a certain threshold, or removing consecutive cepstral coefficients with an index higher than a preset threshold.

A frequency mask is derived from the derived approximation of the spectral density estimate in an action 608, by inverting the derived approximation, i.e. the smoothed spectral density estimate. A special gain in form of emphasized damping is assigned to the frequency mask in a predefined frequency range, i.e. a sub-set of the frequency range of the mask, in an action 610. The frequency mask is then used or applied for damping frequencies comprised in the signal time segment in an action 612. The damping could involve multiplying the frequency mask with the estimated spectral density in the frequency domain, or, a FIR filter could be configured based on the frequency mask, which FIR filter could be used on the audio signal time segment in the time domain.

The emphasized damping could be achieved by raising the damping of the frequency mask to the power of a constant X inside the predefined frequency range, where X could be set >1.In addition to the emphasized damping assigned in a predefined frequency range, the frequency mask could be configured in different ways. For example, the maximum gain of the frequency mask could be set to 1, thus ensuring that no frequencies of the signal would be amplified when being processed based on the frequency mask. Further, the maximum damping (minimum gain) of the frequency mask could be predefined to a certain level, or, the smoothed estimated spectral density could be normalized by the unsmoothed estimated spectral density in the frequency mask.

Figure 7:
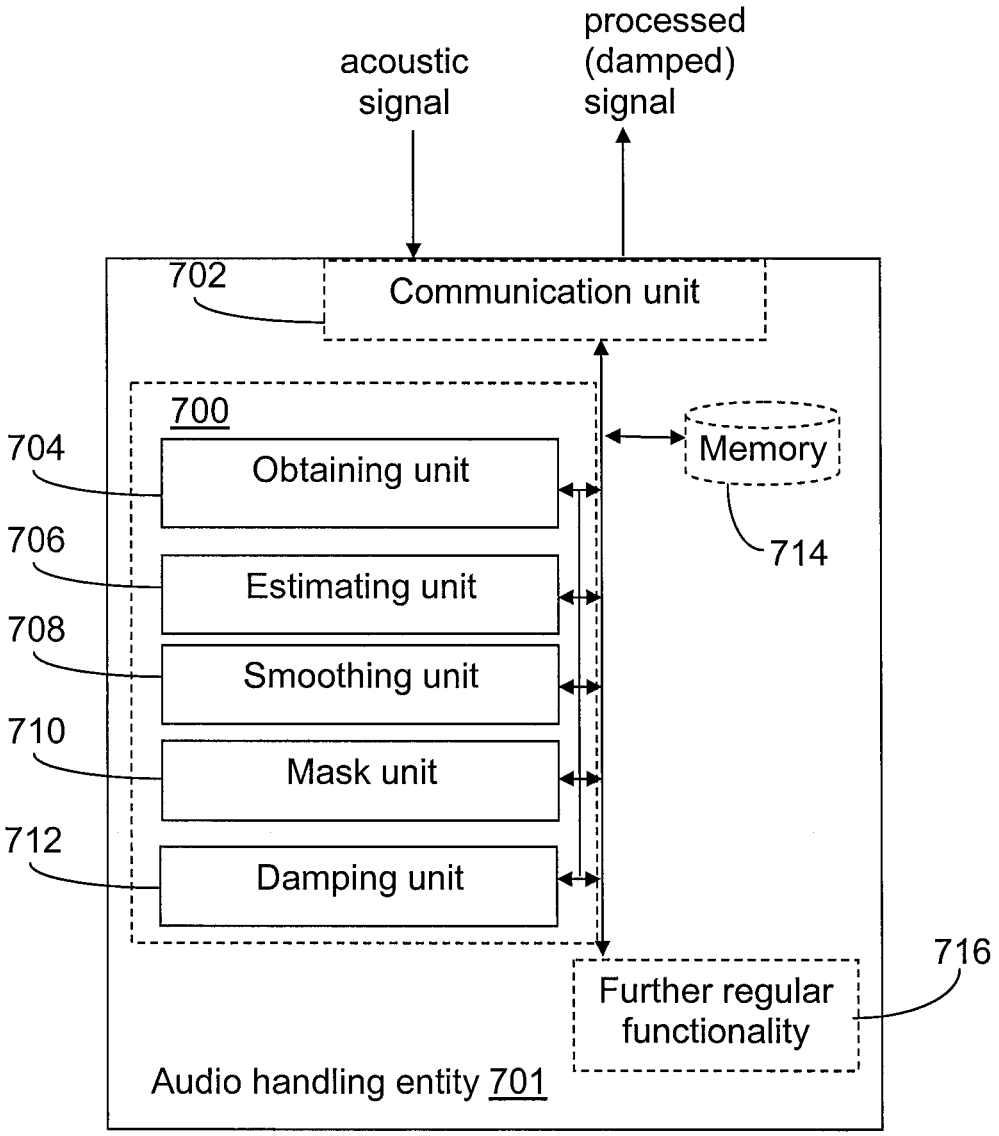
FIG. 7 is a block diagram illustrating an arrangement in an audio handling entity, according to an exemplifying embodiment.

Example Arrangement, FIG. 7

Below, an example arrangement 700, adapted to enable the performance of the above described procedures related to damping of certain frequencies in a time segment of an audio signal, will be described with reference to FIG. 7. The arrangement is illustrated as being located in an audio handling entity 701 in a communication system. The audio handling entity could be e.g. a node or terminal in a teleconference system and/or a node or terminal in a wireless or wired communication system, a node involved in audio broadcasting, or an entity or device used in music production. The arrangement 700 is further illustrated as to communicate with other entities via a communication unit 702, which may be considered to comprise conventional means for wireless and/or wired communication. The arrangement and/or audio handling entity may further comprise other regular functional units 716, and one or more storage units 714.

The arrangement 700 comprises an obtaining unit 704, which is adapted to obtain a time segment of an audio signal. The audio signal could comprise e.g. speech produced by one or more speakers taking part in a teleconference or some other type of communication session. For example, a set of consecutive samples representing a time interval of e.g. 10 ms could be obtained. The audio signal is assumed to have been captured by a microphone or similar and sampled with a sampling frequency. The audio signal may have been captured and/or sampled by the obtaining unit 704, by other functional units in the audio handling entity 701, or in another node or entity.

The arrangement further comprises an estimating unit 706, which is adapted to derive an estimate of the spectral density of the time segment. The unit 706 could be adapted to derive e.g. a periodogram, e.g. by use of a Fourier transform method, such as the FFT. Further, the arrangement comprises a smoothing unit 708, which is adapted to derive an approximation of the spectral density estimate by smoothing the estimate. The approximation should be rather "rough", i.e.

not be very close to the spectral density estimate, which is typically erratic for audio signals, such as e.g. speech or music (cf. FIG. 2). The smoothing unit 708 could be adapted to achieve the smoothed spectral density estimate by use of a cepstrum thresholding algorithm, removing (in the cepstrum domain) cepstral coefficients according to a predefined rule, e.g. removing the cepstral coefficients having an absolute amplitude value below a certain threshold, or removing consecutive cepstral coefficients with an index higher than a preset threshold.

The arrangement 700 further comprises a mask unit 710, which is adapted to derive a frequency mask by inverting the approximation of the estimated spectral density, i.e. the smoothed spectral density estimate. The arrangement, e.g. the mask unit 710 is further adapted to assign a special gain in form of emphasized damping to the frequency mask in a predefined frequency range, i.e. such that damping is emphasized in the considered frequency band, in relation to the gain for the out-of-band frequencies. For example, the arrangement could be adapted to achieve the emphasized damping by raising the damping of the frequency mask to the power of a constant X inside the predefined frequency range. The predefined frequency range could be located within 2-12 kHz, which would entail that the arrangement would be suitable for de-essign.

The mask unit 710 may be adapted to configure the maximum gain of the frequency mask to 1, thus ensuring that no frequencies will be amplified. The mask unit 710 may further be adapted to configure the maximum damping of the frequency mask to a certain predefined level, or to normalize the smoothed estimated spectral density by the unsmoothed estimated spectral density when deriving the frequency mask.

Further, the arrangement comprises a damping unit 712, which is adapted to damp frequencies comprised in the audio time segment, based on the frequency mask. The damping unit 712 could be adapted e.g. to multiply the frequency mask with the estimated spectral density in the frequency domain, or, to configure a FIR filter based on the frequency mask, and to use the FIR filter for filtering the audio signal time segment in the time domain.

Figure 8:
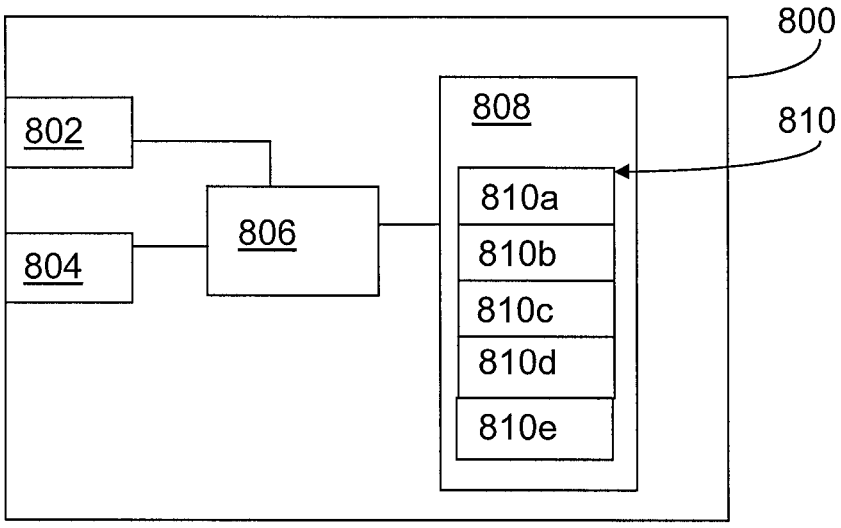
FIG. 8 is a block diagram illustrating an arrangement in an audio handling entity, according to an exemplifying embodiment.

Exemplifying Alternative Arrangement, FIG. 8

FIG. 8 illustrates an alternative arrangement 800 in an audio handling entity, where a computer program 810 is carried by a computer program product 808, connected to a processor 806. The computer program product 808 comprises a computer readable medium on which the computer program 810 is stored. The computer program 810 may be configured as a computer program code structured in computer program modules. Hence in the example embodiment described, the code means in the computer program 810 comprises an obtaining module 810*a* for obtaining a time segment of an audio signal. The computer program further comprises an estimating module 810*b* for deriving an estimate of the spectral density of the time segment. The computer program 810 further comprises a smoothing module 810*c* for deriving an approximation of the spectral density estimate by smoothing the estimate; and a mask module 810*d* for deriving a frequency mask by inverting the approximation of the estimated spectral density and assigning a special gain in form of emphasized damping to the frequency mask in a predefined frequency range. The computer program further comprises a damping module 810*e* for damping frequencies comprised in the audio time segment, based on the frequency mask.

The modules 810*a-e* could essentially perform the actions of the flow illustrated in FIG. 6, to emulate the arrangement in an audio handling entity illustrated in FIG. 7. In other words, when the different modules 810*a-e* are executed in the processing unit 806, they correspond to the respective functionality of units 704-712 of FIG. 7. For example, the computer program product may be a flash memory, a RAM (Random-access memory) ROM (Read-Only Memory) or an EEPROM (Electrically Erasable Programmable ROM), and the computer program modules 810*a-e* could in alternative embodiments be distributed on different computer program products in the form of memories within the arrangement 800 and/or the transceiver node. The units 802 and 804 connected to the processor represent communication units e.g. input and output. The unit 802 and the unit 804 may be arranged as an integrated entity.

Although the code means in the embodiment disclosed above in conjunction with FIG. 8 are implemented as computer program modules which when executed in the processing unit causes the arrangement and/or transceiver node to perform the actions described above in the conjunction with figures mentioned above, at least one of the code means may in alternative embodiments be implemented at least partly as hardware circuits.

It is to be noted that the choice of interacting units or modules, as well as the naming of the units are only for exemplifying purpose, and network nodes suitable to execute any of the methods described above may be configured in a plurality of alternative ways in order to be able to execute the suggested process actions.

It should also be noted that the units or modules described in this disclosure are to be regarded as logical entities and not with necessity as separate physical entities.

Abbreviations

AEC Acoustic Echo Control

DRC Dynamic Range Compression

FIR Finite length Impulse Response

FFT Fast Fourier Transform

References

[1] Stoica, P., Sandgren, N. Smoothed Nonparametric Spectral Estimation via Cepstrum Thresholding. IEEE Sign. Proc. Mag. 2006.

[2] Stoica, P., Sandgren, N. Total Variance Reduction via Thresholding: Application to Cepstral Analysis. IEEE Trans. Sign. Proc. 2007.

The invention claimed is:

1. A method in an audio handling entity for damping of dominant frequencies in a time segment of an audio signal, the method comprising:

obtaining a time segment of an audio signal;

deriving an estimate of the spectral density of the time segment;

deriving an approximation of the estimated spectral density by smoothing the estimate;

deriving a frequency mask by inverting the approximation of the estimated spectral density, the output of the inverting producing a frequency domain signal as the frequency mask;

assigning an emphasized damping to the frequency mask in a predefined frequency range in the audio frequency spectrum, as compared to the damping outside the predefined frequency range; and damping frequencies comprised in the audio time segment based on the frequency mask.

2. The method according to claim 1, wherein the emphasized damping is achieved by raising the damping of the frequency mask to the power of a constant $\chi$ inside the predefined frequency range.

3. The method according to claim 2, wherein $\chi>1$.

4. The method according to claim 1, wherein the method is suitable for de-essing.

5. The method according to claim 1, wherein the predefined frequency range is located within 2-12 kHz.

6. The method according to claim 1, wherein the smoothing involves deriving cepstral coefficients of the spectral density estimate, and at least one of:

removing cepstral coefficients having an absolute amplitude value below a certain threshold; and removing consecutive cepstral coefficients with index higher than a preset threshold.

7. The method according to claim 1, wherein the frequency mask is configured to have a maximum gain of 1.

8. The method according to claim 1, wherein the maximum damping of the frequency mask is predefined to a certain level.

9. The method according to claim 1, wherein the frequency mask $F_p$ is defined as:

$$F_p = 1 - \lambda \frac{\tilde{\phi}_p}{\max(\tilde{\phi}_p)},$$

where $0<\lambda<1$, and $p=0, \ldots, N-1$; where N is the number of samples of the audio signal time segment; and $\tilde{\Phi}_p$ is the smoothed estimated spectral density.

10. The method according to claim 1, wherein, in the frequency mask, the smoothed estimated spectral density is normalized by the unsmoothed estimated spectral density.

11. The method according to claim 1, wherein the frequency mask $F_p$ is defined as:

$$F_p = 1 - \frac{\tilde{\phi}_p}{\max(\tilde{\phi}_p)},$$

where $p=0, \ldots, N-1$; and where N is the number of samples of the audio signal time segment, $\Phi_p$ is the estimated spectral density, and $\tilde{\Phi}_p$ is the smoothed estimated spectral density.

12. The method according to claim 1, wherein the estimate of the spectral density of the signal segment is a periodogram.

13. The method according to claim 1, wherein the damping involves at least one of:

multiplying the frequency mask with the estimated spectral density in the frequency domain; and configuring a FIR filter based on the frequency mask, for use on the audio signal time segment in the time domain.

14. An audio signal processing apparatus comprising:

a processor; and a memory containing instructions executable by said processor, whereby said audio signal processing apparatus is operative to:

obtain a time segment of an audio signal, derive an estimate of the spectral density of the time segment, derive an approximation of the spectral density estimate by smoothing the estimate, derive a frequency mask by inverting the approximation of the estimated spectral density, the output of the inverting producing a frequency domain signal as the frequency mask, assign an emphasized damping to a predefined frequency range of the frequency mask, and damp frequencies comprised in the audio time segment based on the frequency mask.

15. audio signal processing apparatus according to claim 14, adapted to achieve the emphasized damping by raising the damping of the frequency mask to the power of a constant $\chi$ inside the predefined frequency range.

16. The audio signal processing apparatus according to claim 14, wherein the predefined frequency range is located within 2-12 kHz.

17. The audio signal processing apparatus according to claim 14, wherein the smoothing involves deriving cepstral coefficients of the spectral density estimate and removing cepstral coefficients according to a predefined rule.

18. audio signal processing apparatus according to claim 17, wherein the predefined rule involves one of:

removing cepstral coefficients having an absolute amplitude value below a certain threshold; and removing consecutive cepstral coefficients with index higher than a preset threshold.

19. The audio signal processing apparatus according to claim 14, wherein the frequency mask is configured to have a maximum gain of 1.

20. The audio signal processing apparatus according to claim 14, wherein the frequency mask is configured to have a maximum damping predefined to a certain level.

21. The audio signal processing apparatus according to claim 14, wherein, in the frequency mask, the smoothed estimated spectral density is normalized by the unsmoothed estimated spectral density.

22. The audio signal processing apparatus according to claim 14, wherein the damping involves at least one of:

multiplying the frequency mask with the estimated spectral density in the frequency domain; and configuring a FIR filter based on the frequency mask, for use on the audio signal time segment in the time domain.

23. The method of claim 1, wherein the smoothing is non-parametric.

24. The method of claim 6, wherein the smoothed estimated spectral density $\tilde{\Phi}_p$ is defined as:

$$\tilde{\Phi}_p = \alpha \hat{\Phi}_p,$$

where $$\hat{\Phi}_p = \exp\left[\sum_{k=0}^{N-1} \hat{c}_k e^{-ik\omega_p k}\right];$$

where $\omega_p$ are a sequence of Fourier grid points; where $p=0, \ldots, N-1$; where N is the number of samples of the audio signal time segment; where $\alpha$ is a normalization constant; and where the sequence $\hat{c}_k$ is the modified sequence of cepstral coefficients.

25. The method of claim 24, wherein the normalization constant $\alpha$ is defined as:

$$\alpha \frac{\sum_{p=0}^{N-1} \Phi_p \hat{\Phi}_p}{\sum_{p=0}^{N-1} \hat{\Phi}_p^2},$$

where

-continued $$\hat{\Phi}_p = \exp\left[\sum_{k=0}^{N-1} \hat{c}_k e^{i\omega_p k}\right];$$

where $\omega_p$ are a sequence of Fourier grid points; where p=0, . . . , N−1; where N is the number of samples of the audio signal time segment; and where the sequence $\hat{c}_k$ is the second sequence of cepstral coefficients.

26. The audio signal processing apparatus of claim 14, wherein the smoothing is non-parametric.

27. The audio signal processing apparatus of claim 18, wherein the smoothed estimated spectral density $\tilde{\Phi}_p$ is defined as:

$$\tilde{\Phi}_p = \alpha\hat{\Phi}_p,$$

where $$\hat{\Phi}_p = \exp\left[\sum_{k=0}^{N-1} \hat{c}_k e^{-i\omega_p k}\right];$$

where $\omega_p$ are a sequence of Fourier grid points; where p=0, . . . , N−1; where N is the number of samples of the audio signal time segment; where a is a normalization constant; and where the sequence $\hat{c}_k$ is the modified sequence of cepstral coefficients.

28. The audio signal processing apparatus of claim 27, wherein the normalization constant $\alpha$ is defined as:

$$\alpha \frac{\sum_{p=0}^{N-1} \Phi_p \hat{\Phi}_p}{\sum_{p=0}^{N-1} \hat{\Phi}_p^2},$$

where $\omega_p$ are a sequence of Fourier grid points; where p=0, . . . , N−1; where N is the number of samples of the audio signal time segment; and where the sequence $\hat{c}_k$ is the second sequence of cepstral coefficients.

* * * * *

UNITED STATES PATENT AND TRADEMARK OFFICE

CERTIFICATE OF CORRECTION

PATENT NO. : 9,066,177 B2
APPLICATION NO. : 13/071779
DATED : June 23, 2015
INVENTOR(S) : Sandgren It is certified that error appears in the above-identified patent and that said Letters Patent is hereby corrected as shown below:

On Title Page 2, in Item (56), under "OTHER PUBLICATIONS", in Column 2, Line 2, delete "Cepsturm" and insert -- Cepstrum --, therefor.

In the specification

In Column 1, Line 49, delete "equalization" and insert -- equalization. --, therefor.

In Column 2, Line 8, delete "required" and insert -- required. --, therefor.

In Column 3, Line 17, delete "de-assign" and insert -- de-essing --, therefor.

In Column 3, Line 44, delete "preference" and insert -- preference. --, therefor.

In Column 6, Line 1, delete "$F_p = 1 - \lambda \frac{\tilde{\Phi}}{\max(\tilde{\Phi}_p)}$" and insert -- $F_p = 1 - \lambda \frac{\tilde{\Phi}_p}{\max(\tilde{\Phi}_p)}$ --, therefor.

In Column 9, Line 25, delete "de-assign." and insert -- de-essing. --, therefor.

In the Claims

In Column 11, Line 35, in Claim 11, delete "$F_p = 1 - \frac{\tilde{\phi}_p}{\max(\tilde{\phi}_p)}$," and insert -- $F_p = 1 - \frac{\tilde{\phi}_p}{\max(\phi_p)}$, --, therefor.

Signed and Sealed this
Fifth Day of April, 2016

Michelle K. Lee

Michelle K. Lee
*Director of the United States Patent and Trademark Office*

In the Claims

In Column 12, Line 1, in Claim 15, delete "audio signal" and insert -- The audio signal --, therefor.

In Column 12, Line 12, in Claim 18, delete "audio signal" and insert -- The audio signal --, therefor.

In Column 12, Line 63, in Claim 25, delete "$\alpha \frac{\sum_{p=0}^{N-1} \Phi_p \hat{\Phi}_p}{\sum_{p=0}^{N-1} \hat{\Phi}_p^2}$," and insert -- $\alpha = \frac{\sum_{p=0}^{N-1} \Phi_p \hat{\Phi}_p}{\sum_{p=0}^{N-1} \hat{\Phi}_p^2}$ --, therefor.

In Column 13, Line 2, in Claim 25, delete "$\hat{\Phi}_p = \exp\left[\sum_{k=0}^{N-1} \hat{c}_k e^{i\omega_p k}\right]$;" and insert -- $\hat{\Phi}_p = \exp\left[\sum_{k=0}^{N-1} \hat{c}_k e^{-i\omega_p k}\right]$; --, therefor.

In Column 14, Line 3, in Claim 27, delete "where a is" and insert -- where α is --, therefor.

In Column 14, Line 15, in Claim 28, delete "$\alpha \frac{\sum_{p=0}^{N-1} \Phi_p \hat{\Phi}_p}{\sum_{p=0}^{N-1} \hat{\Phi}_p^2}$," and insert -- $\alpha = \frac{\sum_{p=0}^{N-1} \Phi_p \hat{\Phi}_p}{\sum_{p=0}^{N-1} \hat{\Phi}_p^2}$ --, therefor.

In Column 14, Line 17, in Claim 28, insert -- where $\hat{\Phi}_p = \exp\left[\sum_{k=0}^{N-1} \hat{c}_k e^{-i\omega_p k}\right]$; --.